US007002517B2

(12) United States Patent
Noujeim

(10) Patent No.: US 7,002,517 B2
(45) Date of Patent: Feb. 21, 2006

(54) FIXED-FREQUENCY BEAM-STEERABLE LEAKY-WAVE MICROSTRIP ANTENNA

(75) Inventor: Karam Michael Noujeim, Sunnyvale, CA (US)

(73) Assignee: Anritsu Company, Morgan Hill, CA (US)

( * ) Notice: Subject to any disclaimer, the term of this patent is extended or adjusted under 35 U.S.C. 154(b) by 116 days.

(21) Appl. No.: 10/600,293

(22) Filed: Jun. 20, 2003

(65) Prior Publication Data

US 2005/0012667 A1 Jan. 20, 2005

(51) Int. Cl.
*H01Q 1/38* (2006.01)

(52) U.S. Cl. ..... 343/700 MS; 343/754; 343/745

(58) Field of Classification Search ..... 343/700 MS, 343/745, 749, 754, 757, 824, 860
See application file for complete search history.

(56) References Cited

U.S. PATENT DOCUMENTS

| | | | | |
|---|---|---|---|---|
| 4,896,033 | A * | 1/1990 | Gautier | 250/215 |
| 4,918,749 | A * | 4/1990 | Entschladen et al. | 455/327 |
| 5,122,809 | A * | 6/1992 | Haruyama et al. | 343/700 MS |
| 5,148,182 | A * | 9/1992 | Gautier et al. | 343/754 |
| 5,448,252 | A | 9/1995 | Ali et al. | |
| 6,005,520 | A | 12/1999 | Nalbandian et al. | |
| 6,028,561 | A * | 2/2000 | Takei | 343/767 |
| 6,285,325 | B1 | 9/2001 | Nalbandian et al. | |
| 6,489,930 | B1 | 12/2002 | Teshirogi et al. | |
| 6,680,703 | B1 * | 1/2004 | McConnell | 343/700 MS |
| 2004/0113842 | A1 * | 6/2004 | du Toit et al. | 343/700 MS |

OTHER PUBLICATIONS

I. J. Bahl and Prakash Bhartia, *Leaky-Wave Antennas Using Artificial Dielectrics at Millimeter Wave Frequencies*, IEEE Transactions on Microwave Theory and Techniques, vol. MTT-28, No. 11, Nov. 1980, pp. 1205-1212.

Heshmatollah Maheri, Makoto Tsutsumi and Nobuaki Kumagai, *Experimental Studies on Magnetically Scannable Leaky-Wave Antennas Having a Corrugated Ferrite Slab/Dielectric Layer Structure*, IEEE Transactions on Antennas And Propagation, vol. AP-36, No. 7, Jul. 1988, pp. 911-917.

Orest Vendik, Igor Mironenko and Leon Ter-Martirosyan, *Superconductors Spur Application of Ferroelectric Films*, Microwaves and RF, vol. 33, No. 7, Jul. 1994, pp. 67-70.

(Continued)

*Primary Examiner*—Tan Ho
(74) *Attorney, Agent, or Firm*—Fliesler Meyer LLP

(57) ABSTRACT

A fixed frequency continuously beam-steerable leaky-wave antenna in microstrip is disclosed. The antenna's radiating strips are loaded with identical shunt-mounted variable-reactance elements, resulting in low reverse-bias-voltage requirements. By varying the reverse-bias voltage across the variable-reactance elements, the main beam of the antenna may be scanned continuously at fixed frequency. The antenna may consist of an array of radiating strips, wherein each strip includes a variable-reactance element. Changing the element's reactance value has a similar effect as changing the length of the radiating strips. This is accompanied by a change in the phase velocity of the electromagnetic wave traveling along the antenna, and results in continuous fixed-frequency main-beam steering. Alternatively, the antenna may consist of two long radiating strips separated by a small gap, wherein identical variable-reactance elements are mounted in shunt across the gap at regular intervals. A continuous change in the reactance value has a similar effect as changing continuously the width of the radiating strips. This results in a continuous change in the phase velocity of the electromagnetic wave traveling along the antenna, thereby achieving continuous fixed-frequency main-beam steering.

14 Claims, 19 Drawing Sheets

OTHER PUBLICATIONS

R. E. Horn, H. Jacobs, K. L. Klohn and E. Freibergs, *Single-Frequency Electronic-Modulated Analog Line Scanning Using a Dielectric Antenna*, IEEE Transactions on Microwave Theory and Techniques, vol. MTT-30, No. 5, May 1982, pp. 816-820.

S. V. Zaitsev and A. T. Fialkovskii, *Edge Effects in Strip Structures With an Arbitrary Grazing Angle of The Wave. Waves in a Microstrip Waveguide*, Radio Phys. Quant. Electron. vol. 24, No. 9, Sep., 1981, pp. 786-791.

Wolfgang Menzel, *A New Travelling-Wave Antenna in Microstrip*, AEU, vol. 33, No. 4, Apr. 1979, pp. 137-140.

A. A. Oliner and K. S. Lee, *The Nature of the Leakage from Higher Modes on Microstrip Line*, 1986 IEEE MTT-S Digest, Baltimore, MD, Jun. 2-4, 986, pp. 57-60.

* cited by examiner

200

300

400

450

FIXED-FREQUENCY BEAM-STEERABLE LEAKY-WAVE MICROSTRIP ANTENNA

CROSS REFERENCE TO RELATED APPLICATIONS

The present application is related to the following United States Patents and Patent Applications, which patents/applications are assigned to the owner of the present invention, and which patents/applications are incorporated by reference herein in their entirety: U.S. patent application Ser. No. 10/439,197, entitled "LEAKY WAVE MICROSTRIP ANTENNA WITH A PRESCRIBABLE PATTERN", filed on Apr. 15, 2003, now U.S. Pat. No. 6,839,030.

FIELD OF THE INVENTION

The current invention relates generally to fixed-frequency beam-steerable leaky-wave antennas, and more particularly to fixed-frequency beam-steerable leaky-wave microstrip antennas.

BACKGROUND OF THE INVENTION

Leaky-wave antennas are electromagnetic traveling-wave radiators fed at one end and terminated in a resistive load at the other. The feeding end is used to launch a wave that travels along the antenna while leaking energy into free space. Power remaining in the traveling wave is absorbed as it reaches the terminated end. The fact that a single feed is used to excite a leaky-wave antenna results in higher radiation efficiency in comparison with a microstrip antenna array. In addition, a leaky-wave antenna does not suffer from spurious-radiation and ohmic losses associated usually with a corporate-fed microstrip array. The aforementioned features of leaky-wave antennas make them well suited for operation at high frequencies.

In 1979, a traveling-wave microstrip antenna based on the first higher-order mode ($EH_1$) in microstrip was first disclosed. A microstrip is defined herein to be an electromagnetic waveguide made up of conducting traces lying on the top surface of a conductor-backed dielectric slab. The antenna was asymmetrically fed by means of a microstrip line as shown in FIG. 1*a*, and transverse slots located along the center line of the antenna were used to suppress the fundamental mode. Using a quarter-wave transformer, the input impedance of the antenna was matched to the characteristic impedance of the microstrip feed line. The antenna radiated an x-polarized main beam at an angle θ of 37.5° away from broadside (the z direction). It exhibited an impedance bandwidth broader than that of the resonant microstrip patch, but also produced a high backlobe level.

It was later shown that the microstrip antenna introduced previously could have been operated as a leaky-wave antenna had it been made longer (4.85 times $\lambda_o$ long instead of 2.23 times $\lambda_o$, where $\lambda_o$ is the free-space wavelength at the design frequency). It was also shown that the high backlobe level exhibited by the previous antenna is due to the fact that 35% of the incident power is reflected at the terminated end, with the backlobe appearing at the same angle as the main beam when measured from broadside. A three-dimensional angled view of the leaky-wave microstrip antenna is shown in FIG. 2.

The main-beam direction of a leaky-wave antenna scans well with frequency. However, attempting to scan the same beam at fixed frequency has so far been either impractical (for example, use of liquid dielectric as disclosed in "Leaky-wave antennas using artificial dielectrics at millimeter-wave frequencies", Bahl et al., IEEE Transactions on Microwave Theory and Techniques, vol. MTT-28, no. 11, pp.1205–1212, November 1980, or biased ferrite as disclosed in "Experimental studies of magnetically scannable leaky-wave antennas having a corrugated ferrite slab/kielectric layer structure", Maheri et al., IEEE Transactions on Antennas and Propagation, vol. AP-36, no7, pp. 911–917, July 1988), inefficient (only 50% efficiency at 40 GHz, as disclosed in "Superconductors spur application of ferroelectric films", Vendik et al., Microwaves & RF, vol. 33, no. 7, pp. 67–70, July 1994), or did not provide a large scan range (only 5°, as disclosed in "Single-frequency electronic-modulated analog-line scanning using a dielectric antenna", Horn et al., IEEE Transactions on Microwave Theory and Techniques, vol. MTT-30, no. 5, pp. 816–820, May 1982).

In 1998, the leaky-wave microstrip antenna previously disclosed was transformed into a periodic structure as shown in FIGS. 3, 4*a* and 4*b*, by Noujeim and Balmain, as discussed in K. M. Noujeim, "Fixed Frequency beam-steerable leaky-wave antennas, "Ph. D. Thesis, University of Toronto, Ontario, Canada, 1998, and K. M. Noujeim and K. G. Balmain, "Fixed-frequency beam-steerable leaky-wave antennas, "XXVIth General Assembly, International Union of Radio Science (URSI), August 1999. Identical varactor diodes were used as phase-shifting elements to series-connect the radiating rectangular patches. Noujeim and Balmain showed that the main beam of the resulting structure may be scanned continuously at fixed frequency by varying the reverse-bias voltage across the varactor diodes from 0 to 900 volts. For a microstrip with a relative dielectric permittivity of 6.15, they obtained a 60° scan range both theoretically and experimentally at a frequency f=5.2 GHz. Due to the fact that the varactor diodes were arranged in series, the maximum voltage required to reverse-bias them is high (900 volts).

Though fixed frequency leaky wave microstrip antennas have developed over the years, there is still a need for better, more efficient implementations. What is needed is a fixed frequency beam-steerable leaky-wave microstrip antenna that improves over the shortcomings and disadvantages over those of the prior art.

SUMMARY OF THE INVENTION

The present invention addresses the limitations and disadvantages of the prior art by introducing a fixed-frequency continuously beam-steerable leaky-wave antenna in microstrip. The antenna's radiating strips are loaded with identical shunt-mounted variable-reactance elements, resulting in low reverse-bias-voltage requirements. The microstrip antenna is excited in its first higher-order mode by means of two equal-amplitude and 180°-out-of-phase signals. These signals are applied to the feed end of the microstrip at two ports. The microstrip antenna length is chosen such that more than 90% of the input power is radiated by the electromagnetic wave by the time it reaches the terminated antenna end. By varying the reverse-bias voltage across the variable-reactance elements, the main beam of the antenna may be scanned continuously at fixed frequency.

In one embodiment, the antenna consists of an array of radiating strips. In this embodiment, each strip includes a variable-reactance element. The variable-reactance element is generally uniform throughout the microstrip. Changing the element's reactance value has a similar effect as changing the length of the radiating strips. This is accompanied by a change in the phase velocity of the electromagnetic wave traveling along the antenna, and results in continuous fixed-frequency main-beam steering.

In another embodiment, the antenna consists of two long radiating strips separated by a small gap. In this embodiment, variable-reactance elements are mounted in shunt across the gap at regular intervals. In one embodiment, the variable-reactance elements are about the same or identical. A continuous change in the reactance value has a similar effect as changing continuously the width of the radiating strips. This results in a continuous change in the phase velocity of the electromagnetic wave traveling along the antenna, thereby achieving continuous fixed-frequency main-beam steering.

The variable-reactance elements can take the form of varactor diodes, ferroelectric films such as BST (Barium Strontium Titanate), or MEMS (Micro-Electro-Mechanical Systems) varactors.

DETAILED DESCRIPTION

The present invention discloses an improved fixed frequency continuously beam-steerable leaky-wave antenna in microstrip. The antenna's radiating strips are loaded with identical shunt-mounted variable-reactance elements, resulting in low reverse-bias-voltage requirements. The microstrip antenna is excited in its first higher-order mode by means of two equal-amplitude and 180°-out-of-phase signals. These signals are applied to the feed end of the microstrip conducting traces at two ports. A port is defined herein to consist of two closely spaced terminals across which a signal may be applied. About ninety percent of the input power is radiated by the electromagnetic wave by the time it reaches the terminated antenna end. By varying the reverse-bias voltage across the variable-reactance elements, the main beam of the antenna may be scanned continuously at fixed frequency.

Figure 1A:
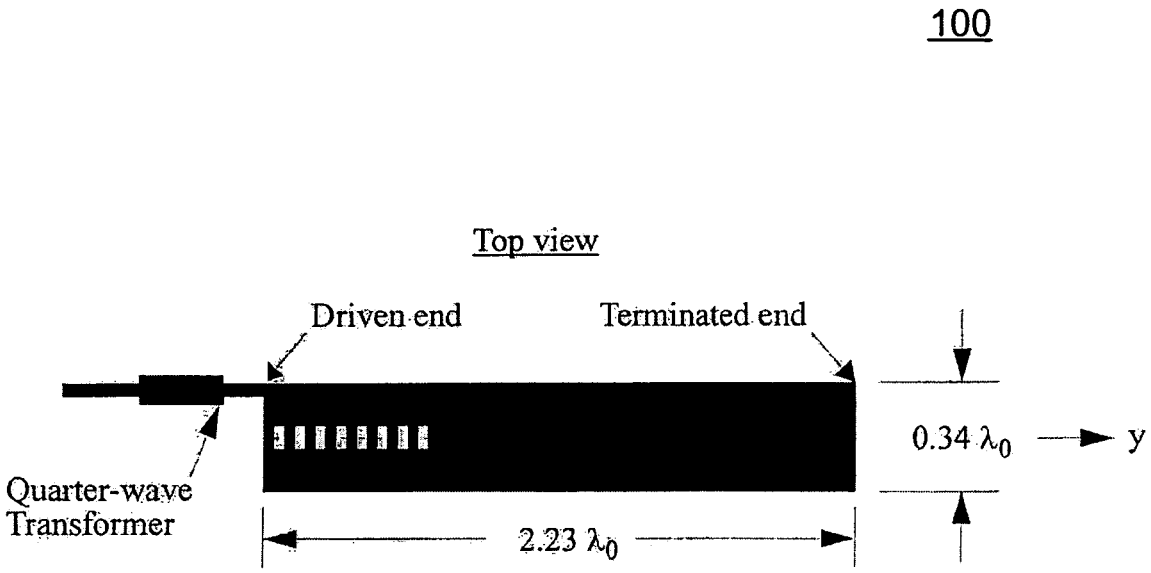
FIG. 1a Prior Art
FIG. 1*a* is an illustration of a top view of a traveling wave microstrip antenna of the prior art.
Figure 1B:
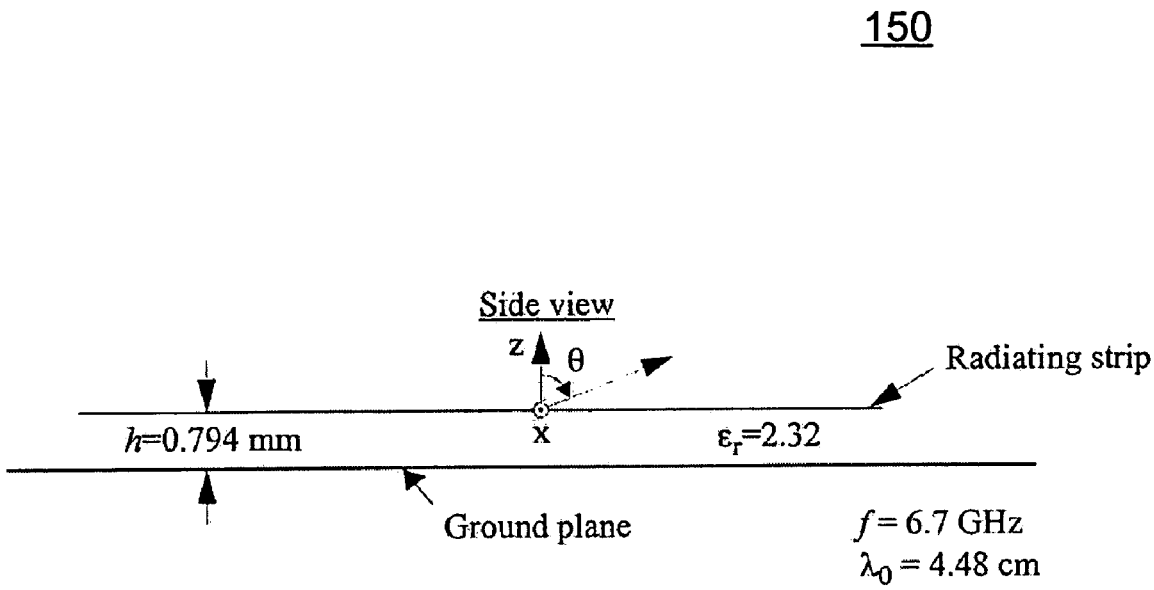
FIG. 1b Prior Art
FIG. 1*b* is an illustration of a side view of a traveling wave microstrip antenna of the prior art.
Figure 2:
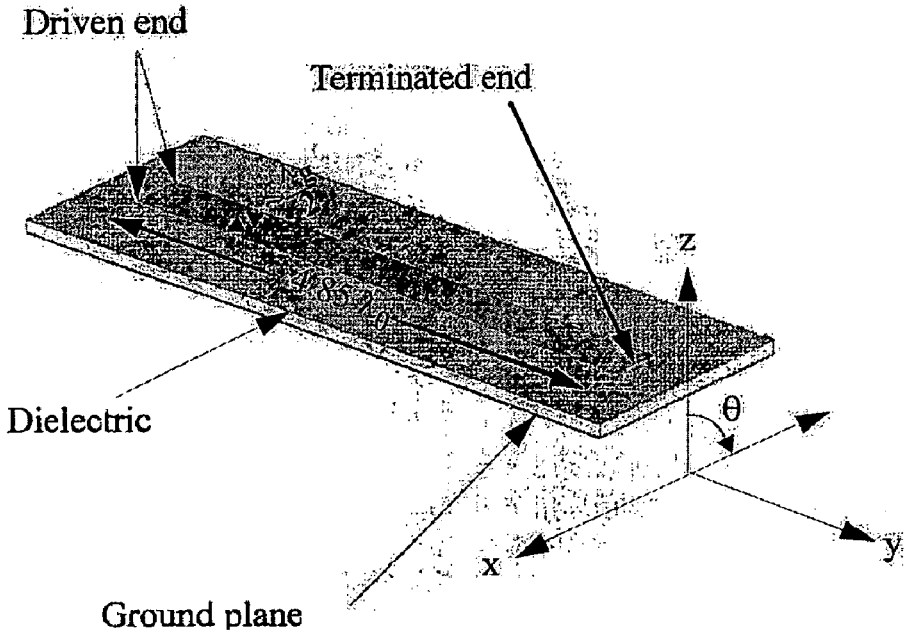
FIG. 2 Prior Art
FIG. 2 is an illustration of a microstrip leaky-wave antenna of the prior art.
Figure 3:
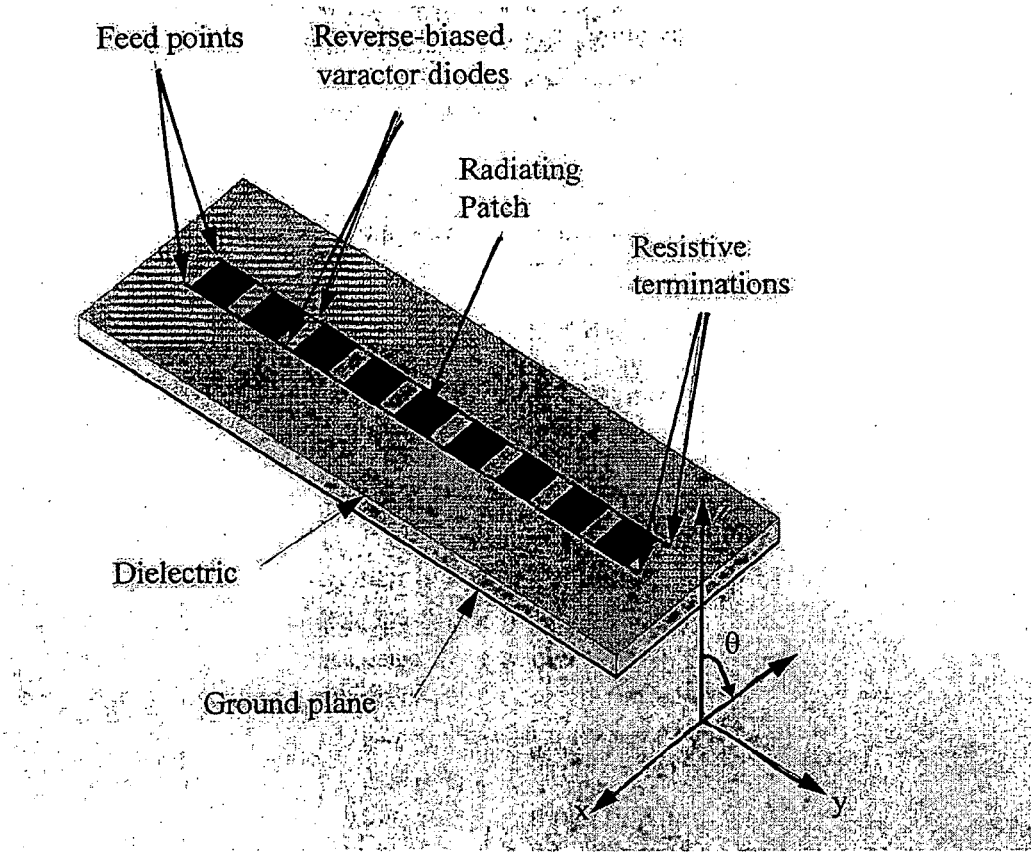
FIG. 3 Prior Art
FIG. 3 is an illustration of a fixed-frequency beam-steerable leaky-wave microstrip antenna of the prior art.
Figure 4A:
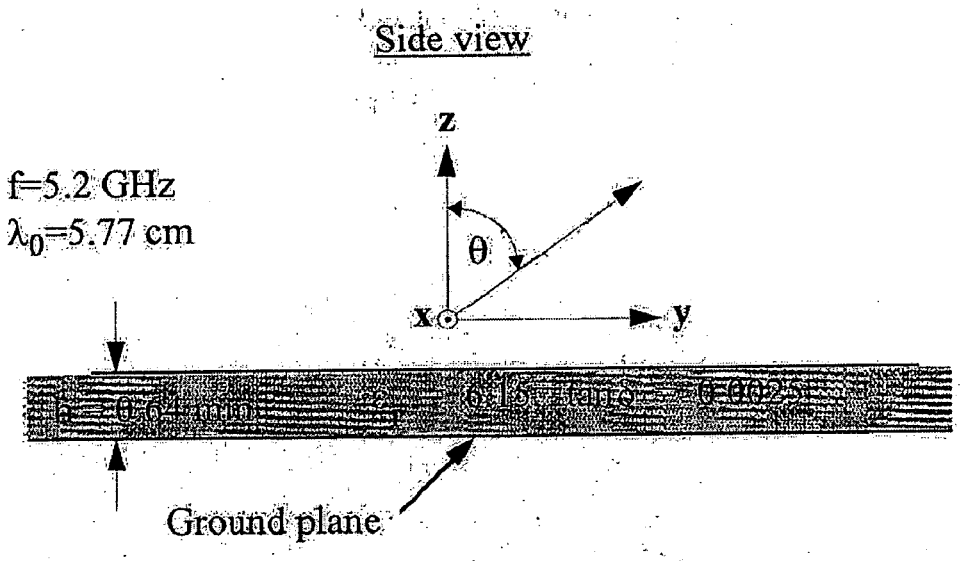
FIG. 4a Prior Art
FIG. 4*a* is an illustration of a side view of a fixed-frequency beam-steerable leaky-wave antenna of the prior art.
Figure 4B:
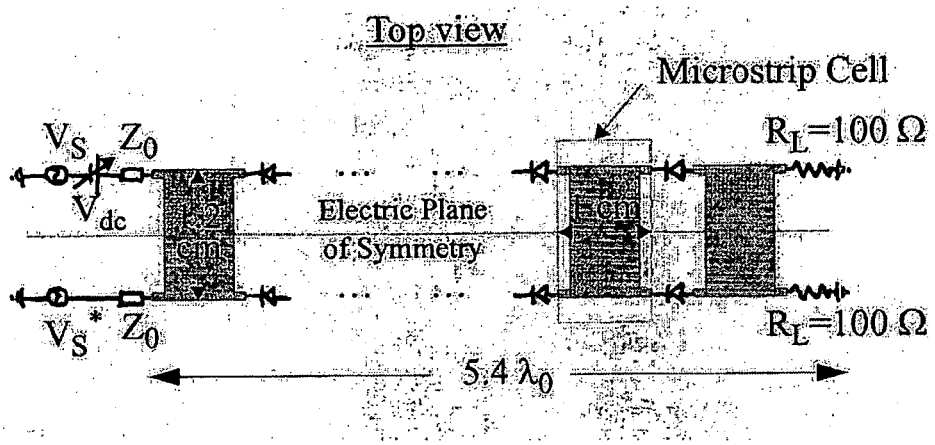
FIG. 4b Prior Art
FIG. 4*b* is an illustration of a top view of a fixed-frequency beam-steerable leaky-wave antenna of the prior art.
Figure 5:
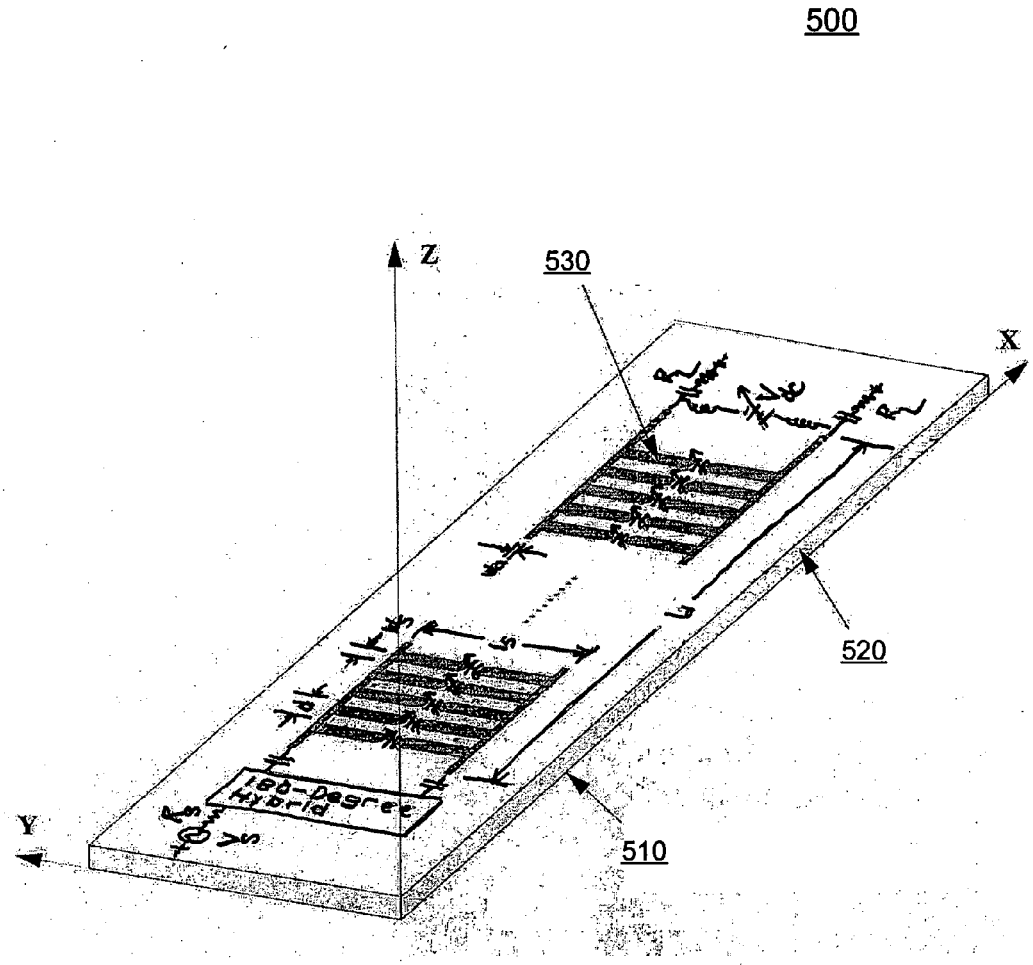
FIG. 5 is an illustration of a reactively loaded fixed-frequency beam-steerable leaky-wave microstrip antenna in accordance with one embodiment of the present invention.

An angled three dimensional view of a reactively loaded fixed frequency beam steerable leaky wave microstrip antenna 500 in accordance with one embodiment of the present invention is illustrated in FIG. 5. Leaky wave microstrip antenna 500 includes a ground plane 510, a dielectric 520 coupled to the ground plane 510, and a radiating strip 530 coupled to the dielectric 520. In one embodiment, the ground plane and radiating strip are comprised of copper. In the embodiment shown, the antenna consists of an array of radiating strips. Each strip includes a variable-reactance element. The variable-reactance element is generally uniform throughout the microstrip. In one embodiment, the variable-reactance elements can take the form of varactor diodes, ferroelectric films such as BST (Barium Strontium Titanate), or MEMS (Micro-Electro-Mechanical Systems) varactors. Changing the element's reactance value has a similar effect as changing the length of the radiating strips. This is accompanied by a change in the phase velocity of the electromagnetic wave traveling along the antenna, and results in continuous fixed-frequency main-beam steering.

Figure 6:
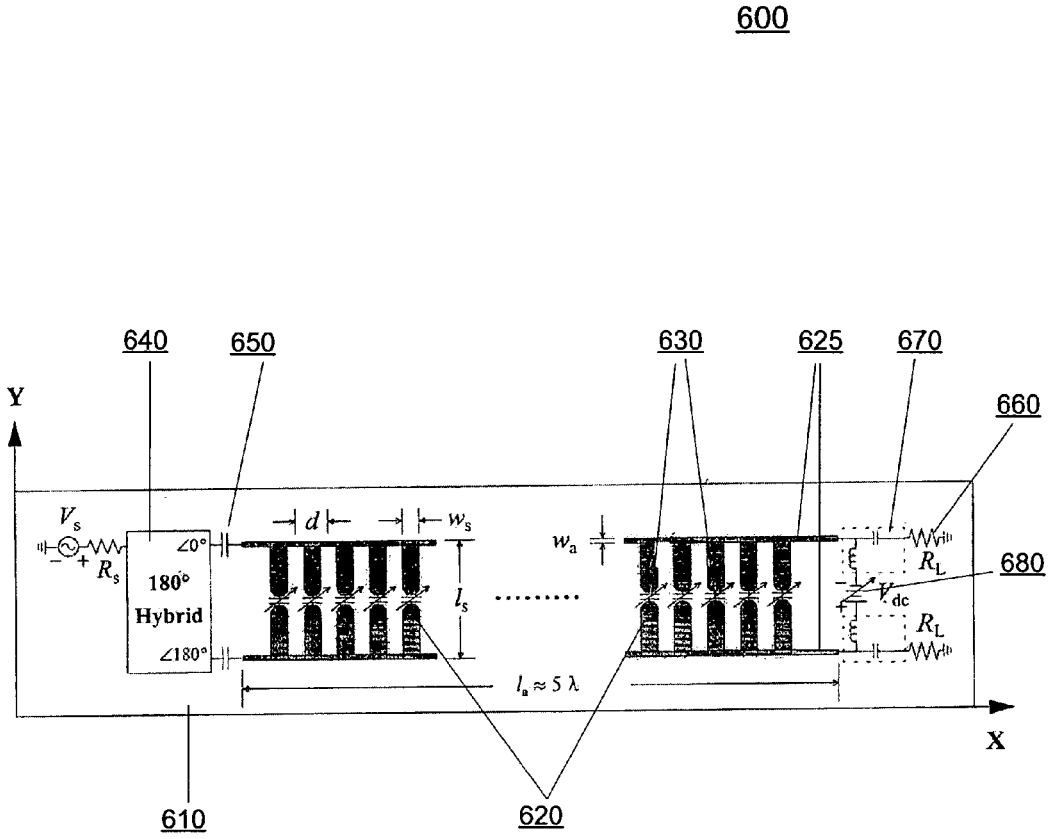
FIG. 6 is an illustration of the top view of a reactively loaded fixed-frequency beam-steerable leaky-wave microstrip antenna in accordance with one embodiment of the present invention.

A top view of the reactively loaded fixed frequency beam steerable leaky wave microstrip antenna of FIG. 5 is illustrated in FIG. 6 in accordance with one embodiment of the present invention. Leaky wave microstrip antenna 600 of FIG. 6 includes conducting traces coupled to a dielectric 610. The conducting traces include a series of radiating strips 620 placed between two non-radiating conducting elements 625. Each of the radiating strips includes a variable-reactance element 630. The microstrip is excited in its first higher-order mode by means of two equal-amplitude and 180 degree-out-of-phase signals. These signals are applied to the feed end of the conducting traces at the port as illustrated. In one embodiment, the driving signals are provided by signal source 640. DC block circuitry 650 may be implemented to block DC signals from the signal source 640. The microstrip antenna is terminated with a resistive load 660. A bias tee 670 and DC voltage source 680 are provided at the terminating ends of the antenna as illustrated.

The length $1_a$ of the microstrip antenna is chosen such that more than ninety percent of the input power is radiated by the electromagnetic wave when it reaches the terminated antenna end. In one embodiment, this length is about 5λ, five times the free space wavelength at the operating frequency. In one embodiment, the length of the radiating strips $1_s$ is about 0.45λg, 0.45 times the guide wavelength at the operating frequency. Thus, the length of the non-radiating conducting elements 625 is about $1_a$. The width $w_a$ of the non-radiating conducting elements is about the same. The width $w_s$ and inter-strip spacing d of the radiating strips is generally uniform throughout the leaky wave microstrip antenna.

Loading the strips with variable reactance elements affects the phase of the wave traveling along the x direction, transverse to the strips. In operation, the microstrip is driven by two equal-amplitude and 180-degree-out-of-phase signals provided by signal source 640. The printed microstrip feed points receive the two signals having a 180 degree phase difference in order to excite the first higher order mode in the microstrip. In one embodiment, the DC block 650 is implemented to prevent DC signals from reaching the signal source. In the embodiment shown, the DC block mechanisms are implemented as capacitors.

The power from the two applied signals is radiated as the electromagnetic wave travels along the microstrip antenna. As mentioned above, the length of the microstrip antenna is chosen such that approximately ninety percent of the wave power will be radiated by the antenna structure as the wave travels along the antenna. In one embodiment, a resistive load $R_L$ 660 is placed at each terminating end of the microstrip to absorb the energy remaining in the traveling wave as it reaches the antenna end.

In one embodiment, additional circuitry may be coupled to the conducting traces to vary the reactance of the cell elements. For purposes of discussion only, the cell elements will be considered capacitors. In the embodiment shown, a DC voltage source 680 is used to vary the voltage across the variable reactance elements, capacitors, 630. As the capacitance is increased, the phase velocity along the antenna is decreased. The decreased phase velocity shifts the y-polarized main-beam maximum toward endfire, closer to the x direction. As the capacitance is decreased, the phase velocity along the antenna increases, thereby causing the y-polarized main-bean maximum to shift toward-broadside, closer to the z direction. In one embodiment, where DC voltage sources are implemented, the conducting traces are coupled to bias tees 680 at each terminating end. One purpose of the bias tees is to allow the application of the DC bias required to control the variable reactance element of each radiating strip, while preventing signal power from reaching the DC source. The bias tees also prevent the DC voltage from being applied to the load resistors 650.

Figure 7:
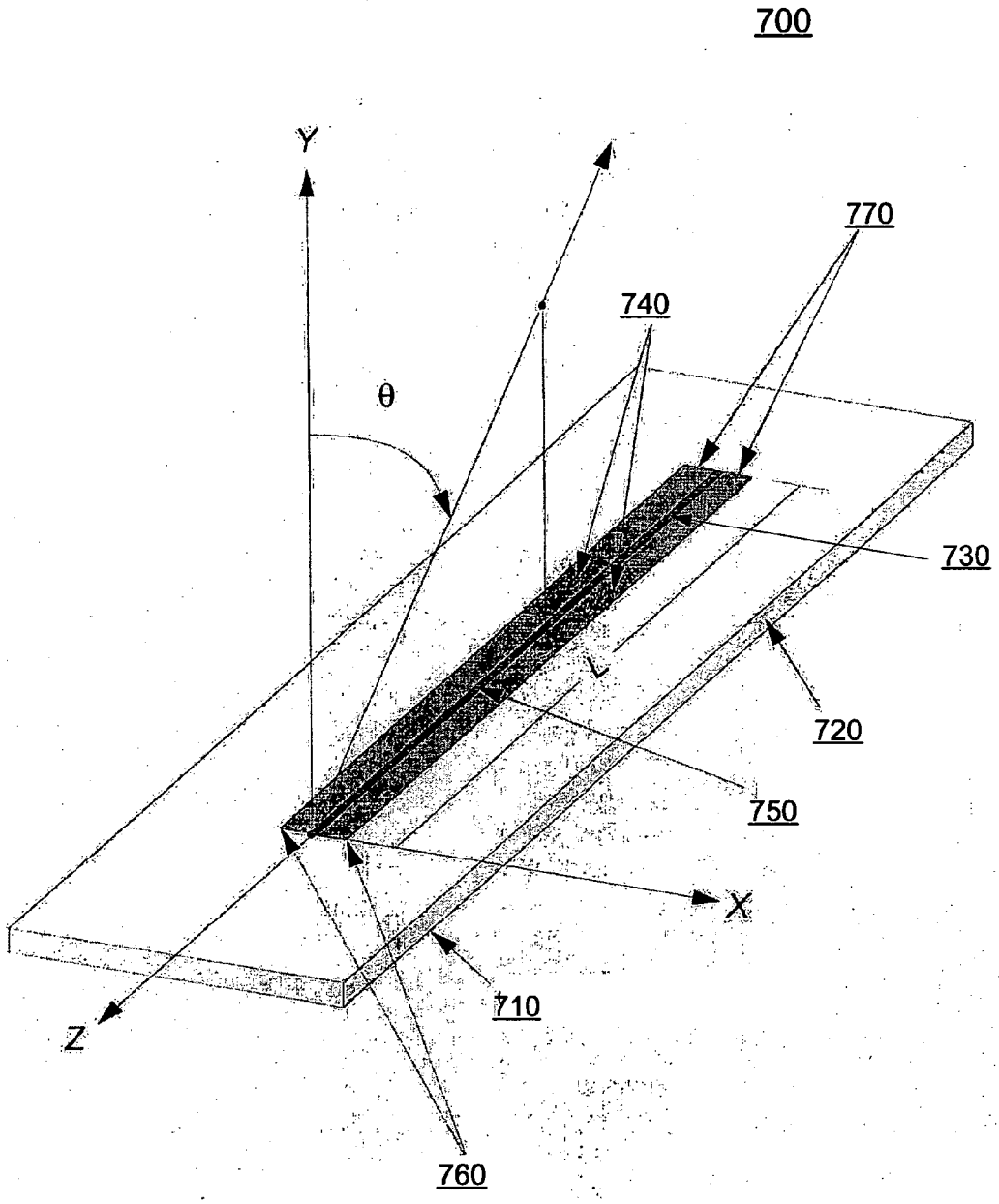
FIG. 7 is an illustration of an angled view of a reactively loaded fixed-frequency beam-steerable leaky-wave microstrip antenna in accordance with one embodiment of the present invention.
Figure 8A:
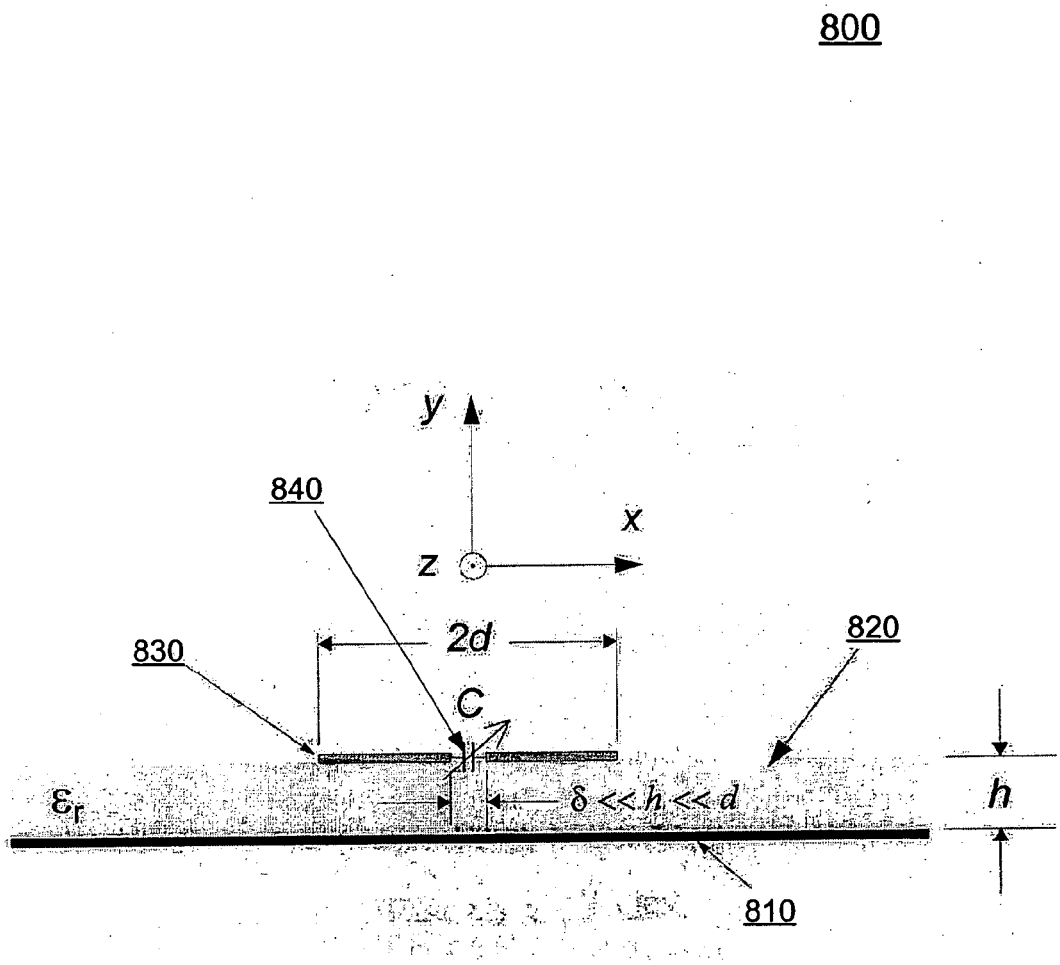
FIG. 8*a* is an illustration of a cross sectional view of a reactively loaded fixed-frequency beam-steerable leaky-wave microstrip antenna in accordance with one embodiment of the present invention.
Figure 8B:
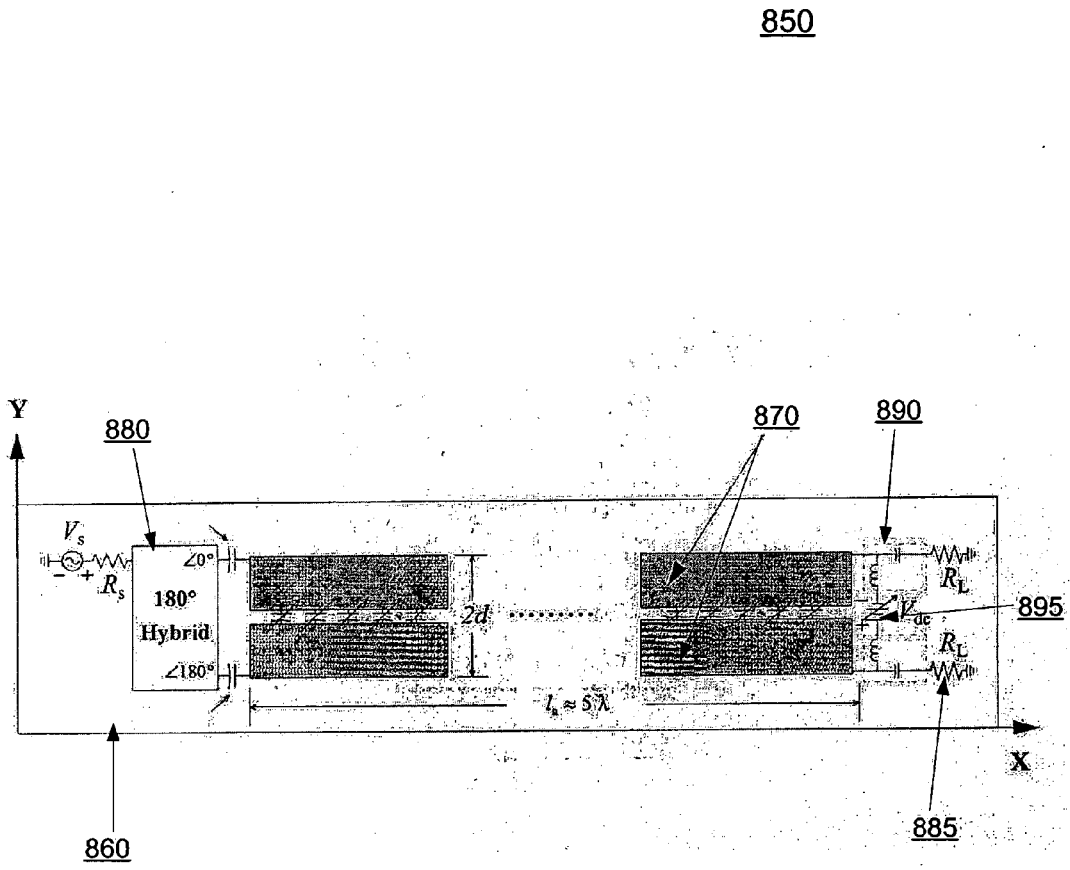
FIG. 8*b* is an illustration of a top view of a reactively loaded fixed-frequency beam-steerable leaky-wave microstrip antenna in accordance with one embodiment of the present invention.

A reactively loaded fixed-frequency beam-steerable leaky-wave microstrip antenna in accordance with another embodiment of the present invention is illustrated in FIGS. 7, 8*a* and 8*b*. Microstrip antenna 700 of FIG. 7 includes a ground plane 710 coupled to dielectric 720. Dielectric 720 is coupled to a loaded strip 730. The loaded strip consists of a pair of radiating strips 740 and variable reactive elements 750. The pair of radiating strips 740 include a driven end 760 and a terminated end 770. The variable reactive elements consist of variable reactance elements placed in shunt at regular intervals between the two radiating strips 740. In one embodiment, the variable reactance elements may be about the same or identical. In another embodiment, the variable reactance elements may be substantially identical varactor diodes. In another embodiment, the variable reactive elements can take the form of a ferroelectric film such as Barium Strontium Titanate (BST) or micro-electromechanical systems (MEMS) varactors placed in shunt at regular intervals between the two radiating strips.

A cross sectional view of a reactively loaded fixed-frequency beam-steerable leaky-wave microstrip antenna 800 is shown in FIG. 8*a*. The microstrip antenna 800 includes a conductor 810 coupled to a dielectric 820. A pair of radiating strips 830 are coupled to dielectric 820. The microstrip antenna is reactively loaded with variable reactive loading elements 840 placed in shunt at regular intervals between the two radiating strip. In the embodiment illustrated in FIG. 8*a*, the variable reactive loading elements are substantially identical varactor diodes. In another embodiment, the reactive loading can take the form of a ferroelectric film such as BST or MEMS varactors.

A top view of a reactively loaded fixed-frequency beam-steerable leaky-wave microstrip antenna 850 is shown in FIG. 8*b*. Microstrip antenna 850 includes dielectric 860 coupled to a pair of radiating strips 870. Dielectric 860 is also coupled to a conducting ground plane, though this plane is not shown in FIG. 8*b*. As illustrated in FIG. 8*b*, the radiating strips are driven by a pair of equal-amplitude and 180-degree-out-of-phase signals generated by signal source 880. The signals travel through the microstrip antenna while radiating energy into free space, reach the terminating end, and are terminated by the termination resistance 885. The terminating end also includes bias tee circuitry 890 and a DC voltage source 895 for biasing the reactive loading elements. As in FIG. 8*a*, the microstrip antenna 850 of FIG. 8*b* is reactively loaded with variable reactive elements placed in shunt at regular intervals between the two radiating strips. In the embodiment illustrated in FIG. 8*b*, the variable reactive elements are identical varactor diodes. The length of the pair of radiating strips is approximately five times the free space wavelength at the operating frequency. The total width of the loaded radiating strips is approximately 0.45 times the guide wavelength at the operating frequency.

The leakage and propagation constants for the fixed frequency beam steerable leaky wave microstrip antenna in the embodiment of the present invention illustrated in FIGS. 7, 8*a* and 8*b* may be calculated as discussed in reference to FIGS. 9–16. The values calculated are intended as examples only, and the scope of the present invention is not intended to be limited by the ranges discussed. Rather, the discussion of calculations is intended to enable the design of fixed-frequency beam-steerable leaky-wave microstrip antennas for different applications.

As illustrated in FIG. 8*a*, a reactive sheet of width $\delta \ll h \ll d$, and surface reactance $X_s = -1/(\omega C)$ (Ω/square) lies along the bisecting line of the top 2d-wide conductor. Here, the dielectric thickness h is chosen such that surface-wave modes beyond the $TM_0$ mode are cutoff.

The structure shown in FIG. 8*a* supports hybrid modes whose complex propagation constants may be found by application of the transverse-resonance technique disclosed in references including "Microstrip leaky-wave antennas," A. A. Oliner and K. S. Lee, 1986 *IEEE International Antennas and Propagation Symposium Digest*, Philadelphia, Pa., pp. 443–446, Jun. 8–13, 1986 (Oliner), "On field representations in terms of leaky modes or eigenmodes," N.

Marcuvitz, *IRE Transactions on Antennas and Propagation*, vol. AP-4, no. 3, pp. 192–194, July 1956, (Marcuvitz), and "Edge effects in strip structures with an arbitrary grazing angle of the wave. Waves in a microstrip waveguide," S. V. Zaitsev and A. T. Fialkovskii, *Radio Phys. Quant. Electron.*, vol. 24, no. 9, pp. 786–791, September 1981 (Zaitsev), all of which are hereby incorporated by reference. The first step of this technique is to predict $Z_h$, the impedance of the open end located at x=±d.

Figure 10:
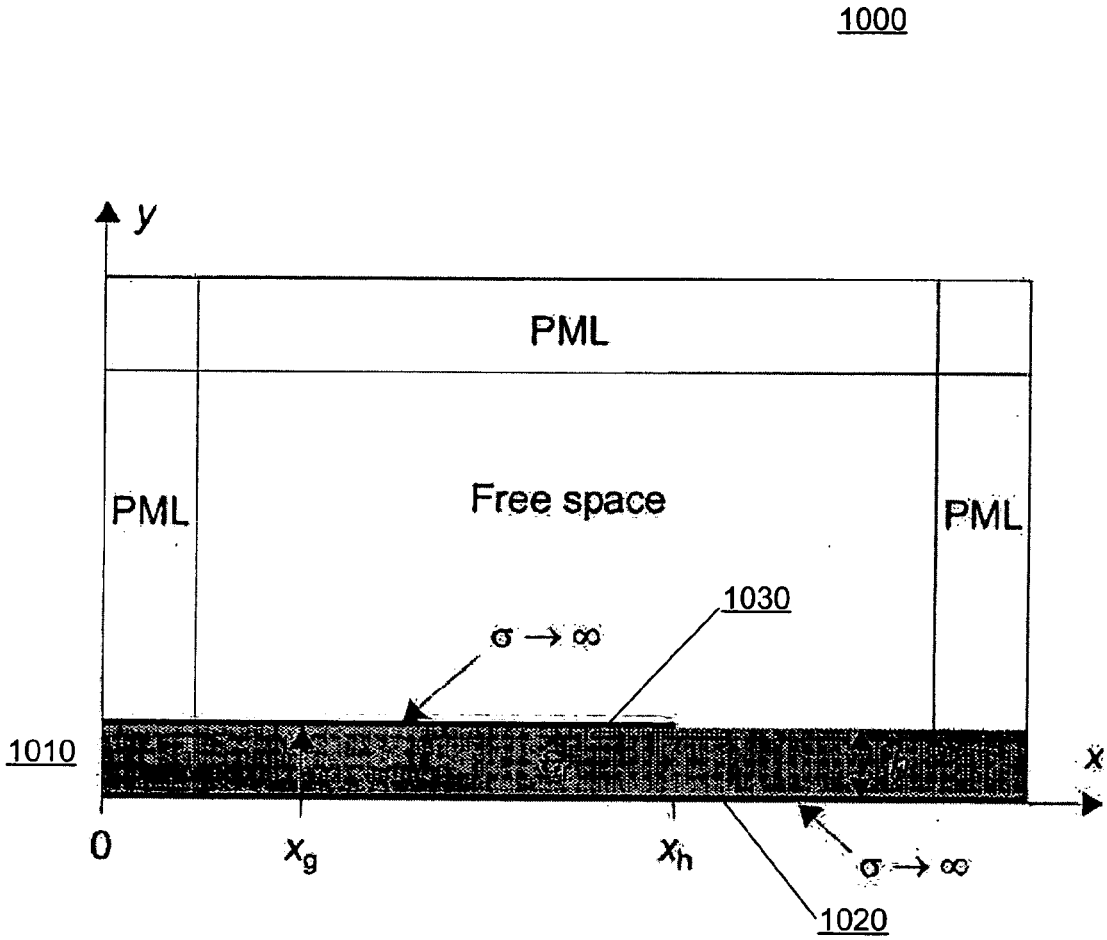
FIG. 10 is a model for determining the open end impedance of the leaky wave antenna in accordance with one embodiment of the present invention.

The open-end impedance is found by making use of the two-dimensional finite-difference time-domain (2D FDTD) technique disclosed in "Numerical solution of initial boundary value problems involving Maxwell's equations in isotropic media," K. S. Yee, *IEEE Transactions on Antennas and Propagation*, vol. 14, pp. 302–307, 1966 (Yee), incorporated herein by reference, in which use is made of a twelve-cell-thick perfectly matched layer (PML) as disclosed in "A perfectly matched layer for the absorption of electromagnetic waves," J.-P. Berenger, *Journal of Computational Physics*, vol. 114, pp. 185–200, 1994, incorporated herein by reference, on the top, left, and right walls as shown in FIG. 10. A y-polarized Gaussian pulse generated by a voltage source located between the conducting bottom wall and the top strip at $x=x_g$ is incident on the open end. The ratio of the Fourier transforms of the y-polarized electric field and z-polarized magnetic field at the open end ($x=x_h$) provides $Z_h$.

Figure 9:
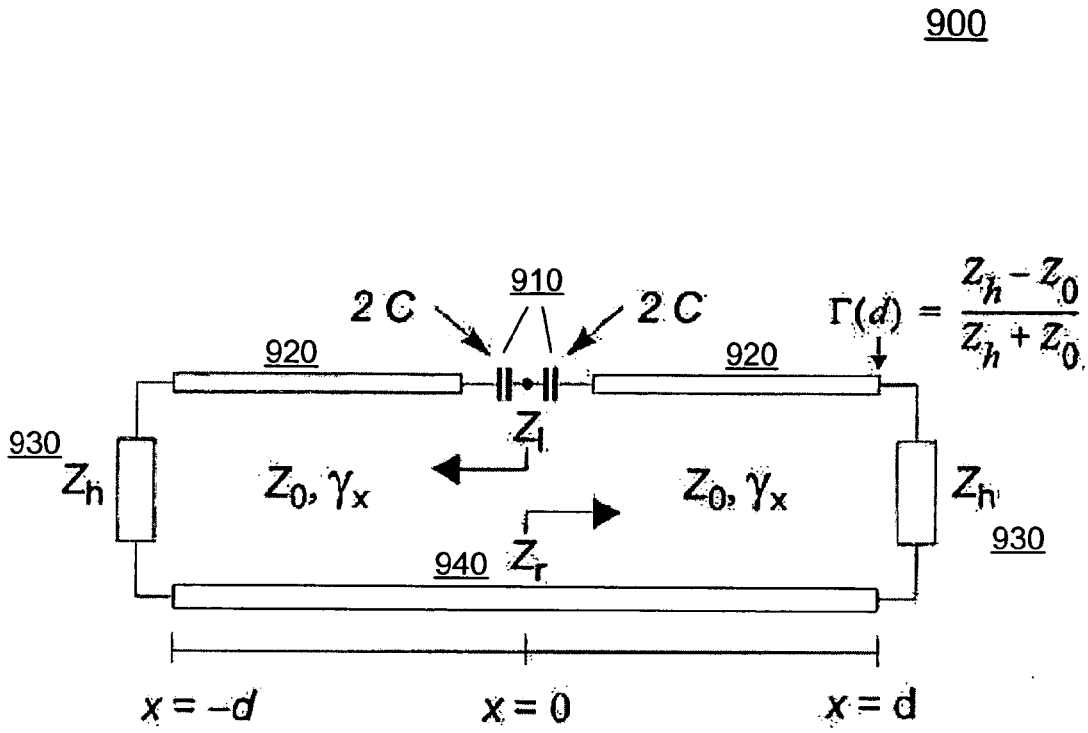
FIG. 9 is an illustration of a transmission-line model for transverse wave propagation in accordance with one embodiment of the present invention.

The transverse-resonance technique may be applied to the circuit shown in FIG. 9. This results in the following equation for the complex propagation constant along the x direction:

$$\gamma_x = \frac{j}{2d}\left(\ln\left|\frac{-js_x/2+z_0}{-jx_s/2-z_0}\right| - \ln|\Gamma(d)| + j(\tau-\phi+2\pi n),\ n=0,1,2,\ldots\right. \quad (1)$$

where n is the propagation-mode index, Γ is the reflection coefficient, $Z_0$ is the TEM wave impedance in a dielectric having a relative constant $\epsilon_r$, $\phi=\mathrm{Arg}(\Gamma(d))$, and:

$$\tau = Arg\left(\frac{-js_x/2+Z_0}{-jx_s/2-Z_0}\right).$$

With $\gamma_x$ known, the complex propagation constant $\gamma_Z$ along the direction of wave propagation may be calculated readily using:

$$\gamma_Z=\sqrt{k_s^2-\gamma_x^2} \quad (2)$$

where $k_s$ is the propagation constant of the $TM_0$ surface-wave mode, assumed by a proper choice of h to be the only propagating mode. Eqs. (1) and (2) show the dependence of $\gamma_z$ on the surface reactance $X_s$, and thus on the reactive loading. The extent of this dependence and its implications will now be illustrated by two antenna examples.

Figure 11:
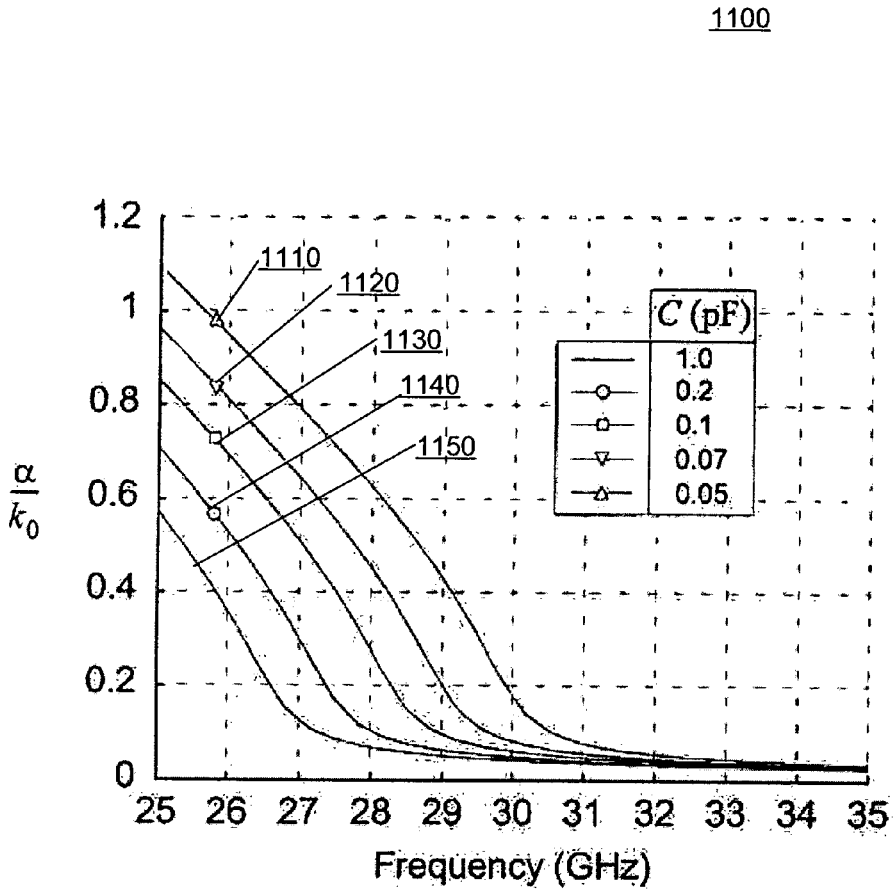
FIG. 11 is an illustration of a plot of the normalized leakage constant in a reactively loaded microstrip in accordance with one embodiment of the present invention.
Figure 12:
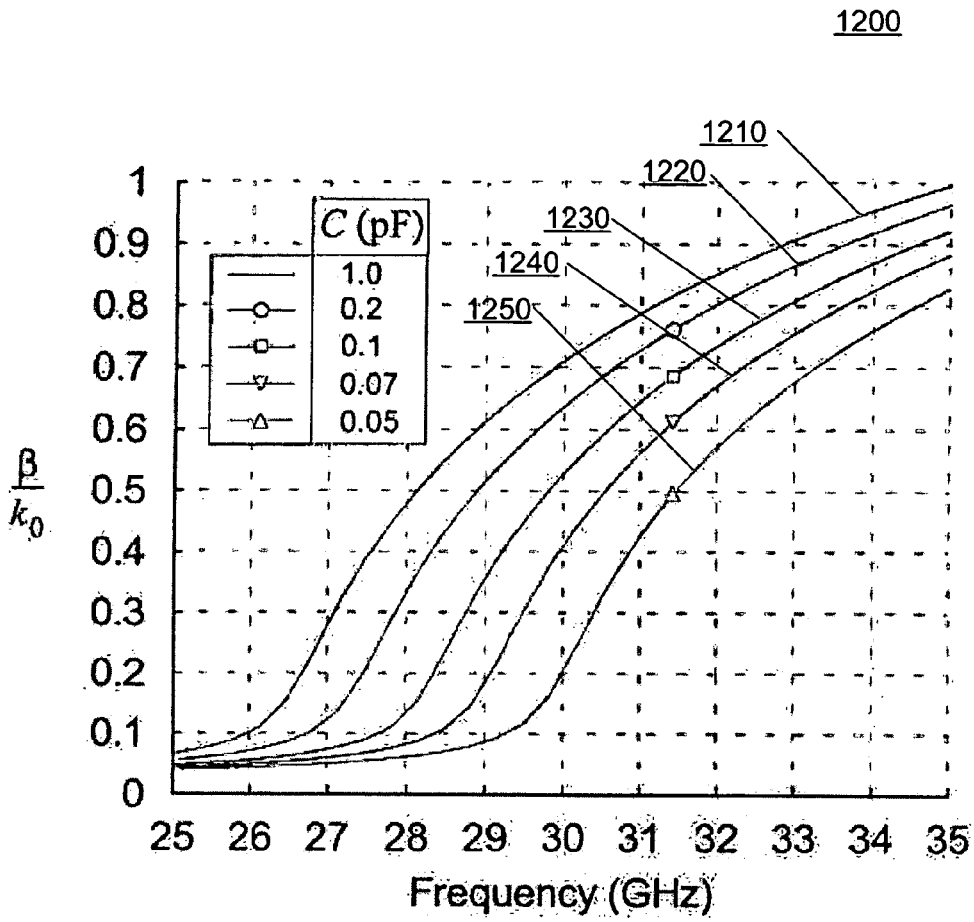
FIG. 12 is an illustration of a plot of the normalized phase constant in a reactively loaded microstrip in accordance with one embodiment of the present invention.

The values of $\gamma_z$ and $\gamma_x$ can be used to calculate normalized values for the leakage and propagation constants of the $EH_1$ mode propagating along a reactively loaded microstrip. The results are shown in FIGS. 11 and 12 for different values of C ranging from 0.05–1.0 pF. For the data plotted in FIGS. 11 and 12, the microstrip dielectric constant $\epsilon_r$=2.2, the dielectric thickness h=0.127 mm, and the strip width 2 d=3.5 mm. FIG. 11 includes plots for values of C at 1.0 pf at 1150, 0.2 pf at 1140, 0.1 pf at 1130, 0.07 pf at 1120, and 0.05 pf at 1110.

FIG. 12 shows that an increasing value of C has the effect of making the microstrip waveguide appear wider, and causes a downward shift in the cutoff frequency of the $EH_1$ mode. Here, a shift of about 3 GHz in the cutoff frequency of the $EH_1$ mode is observed as C is increased from 0.05 to 1 pF. In particular, FIG. 12 illustrates plots of C at 1.0 pf at 1210, 0.2 pf at 1220, 0.1 pf at 1230, 0.07 pf at 1240, 0.05 pf at 1250. FIG. 12 also shows that at a constant frequency f, a continuous increase in the value of C is accompanied by a continuous decrease in the phase velocity along the microstrip, and thus a continuous movement of the main-beam maximum toward endfire.

For a microstrip of length L, the H-plane power-gain pattern may be calculated by treating the microstrip as a line source as discussed in *Antenna Theory and Design*, John Wiley & Sons, Inc., W. L. Stutzman and G. A. Thiele, 605 Third Ave., New York, N.Y. 10158-0012, pp. 137–141 and 173–174, 1981 (Stutzman), incorporated herein by reference, and by making use of the element factor of an x-directed infinitesimal current element lying on a grounded dielectric slab of infinite extent as discussed in "Electric surface current model for the analysis of microstrip antennas with application to rectangular elements," P. Perlmutter, S. Shtrikman, and D. Treves, *IEEE Transactions on Antennas and Propagation*, vol. AP-33, no. 3, pp. 301–311, March 1985 (Perlmutter), also incorporated herein by reference. For a microstrip of length L=4.9 $\lambda_0$, where $\lambda_0$ is the free-space wavelength at f=30 GHz, this approach results in the normalized H-plane power-gain patterns shown in FIG. 13 for different values of C ranging from 0.05–1.0 pF. This choice of L ensures that at least 90% of the input power is radiated by the time the $EH_1$ wave reaches the end of the microstrip.

Figure 13:
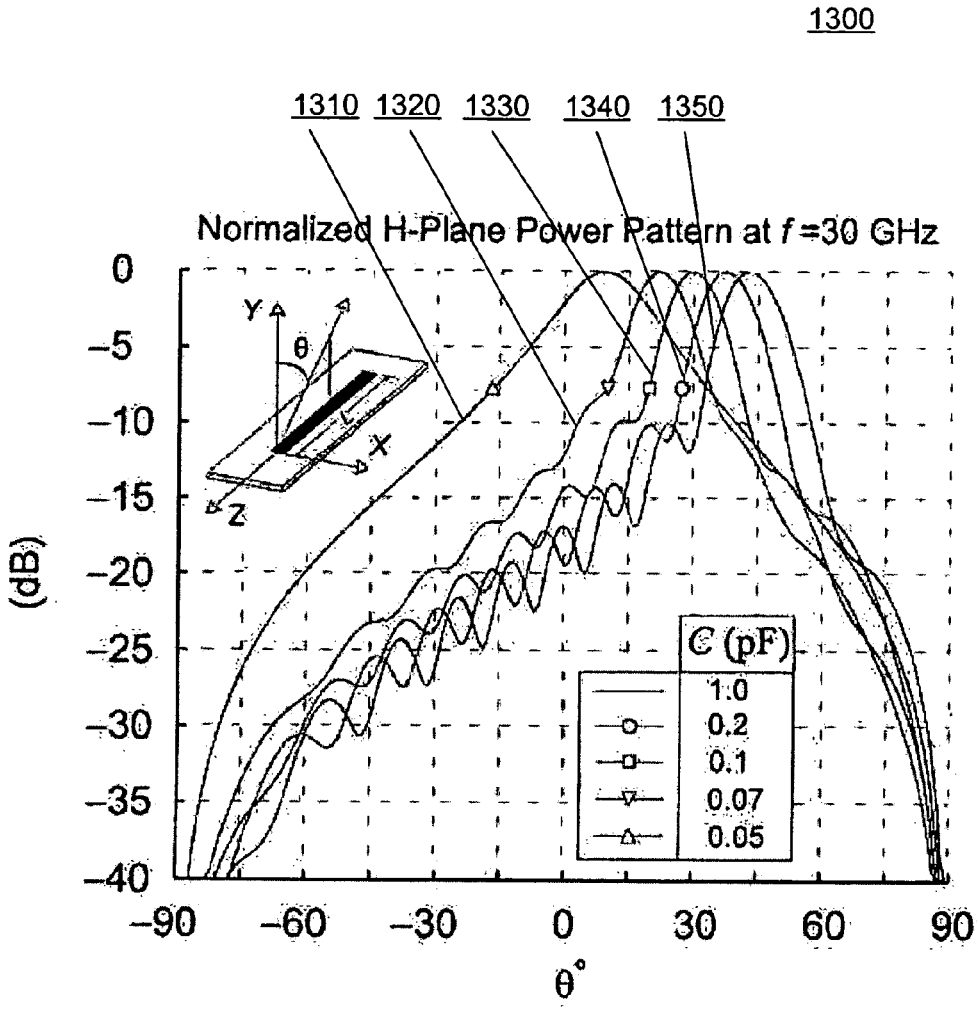
FIG. 13 is an illustration of a plot of the normalized H-plane power gain pattern in a reactively loaded microstrip in accordance with one embodiment of the present invention.
Figure 16:
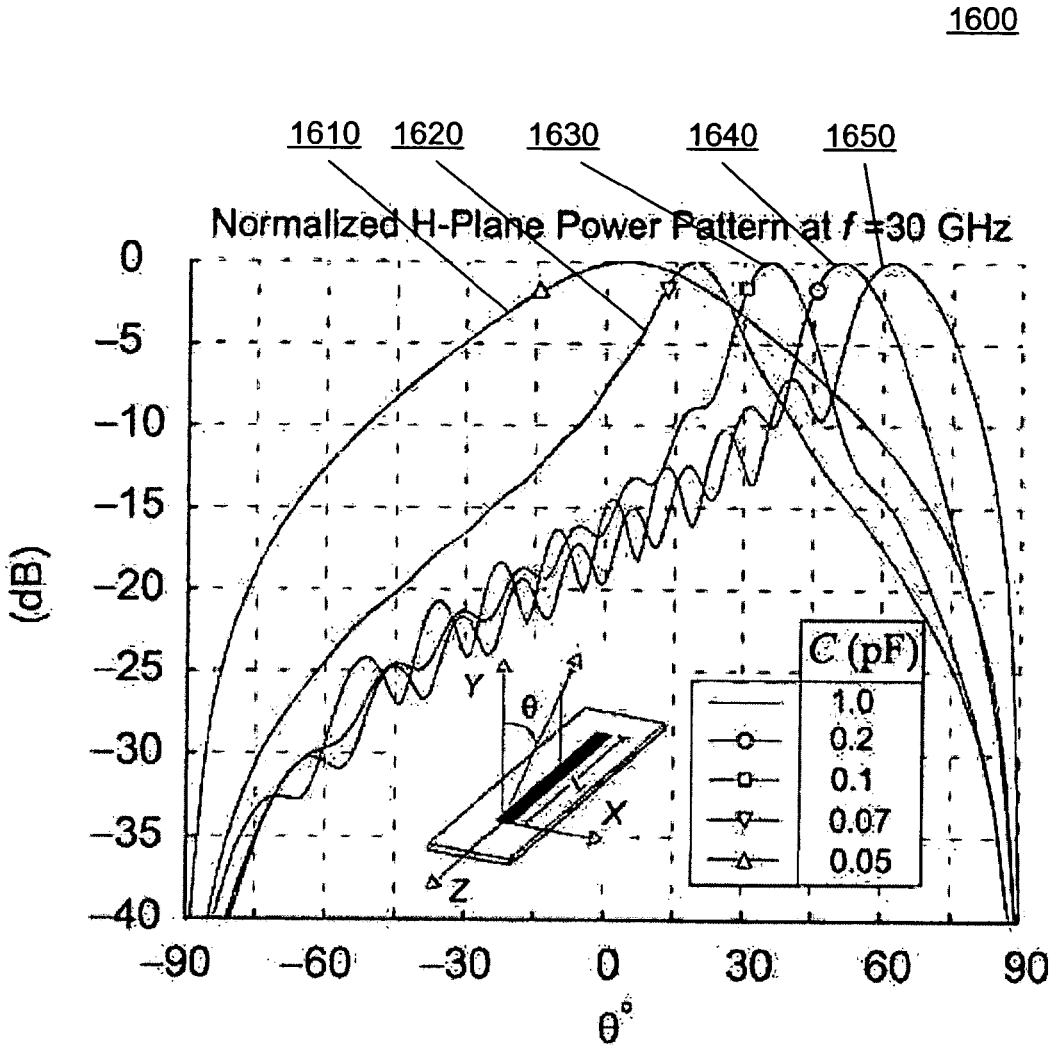
FIG. 16 is an illustration of a plot of the normalized H-plane power gain pattern in a reactively loaded microstrip in accordance with one embodiment of the present invention.

FIG. 13 illustrates the normalized H-plane power pattern for a microstrip excited at f=30 GHz for a microstrip that is 4.9 $\lambda_0$ in length and has dielectric constant $\epsilon_r$=2.2. The normalization factor for each of the power patterns is its maximum power gain. FIG. 16 shows that as C is decreased from 1 to 0.05 pF, the main-beam maximum scans a 35-degree range at a constant frequency f=30 GHz. This is accompanied by a widening of the main beam, and is due mainly to the fact that the leakage constant a shown in FIG. 14 increases as C is decreased, resulting in a shorter radiating aperture.

Figure 14:
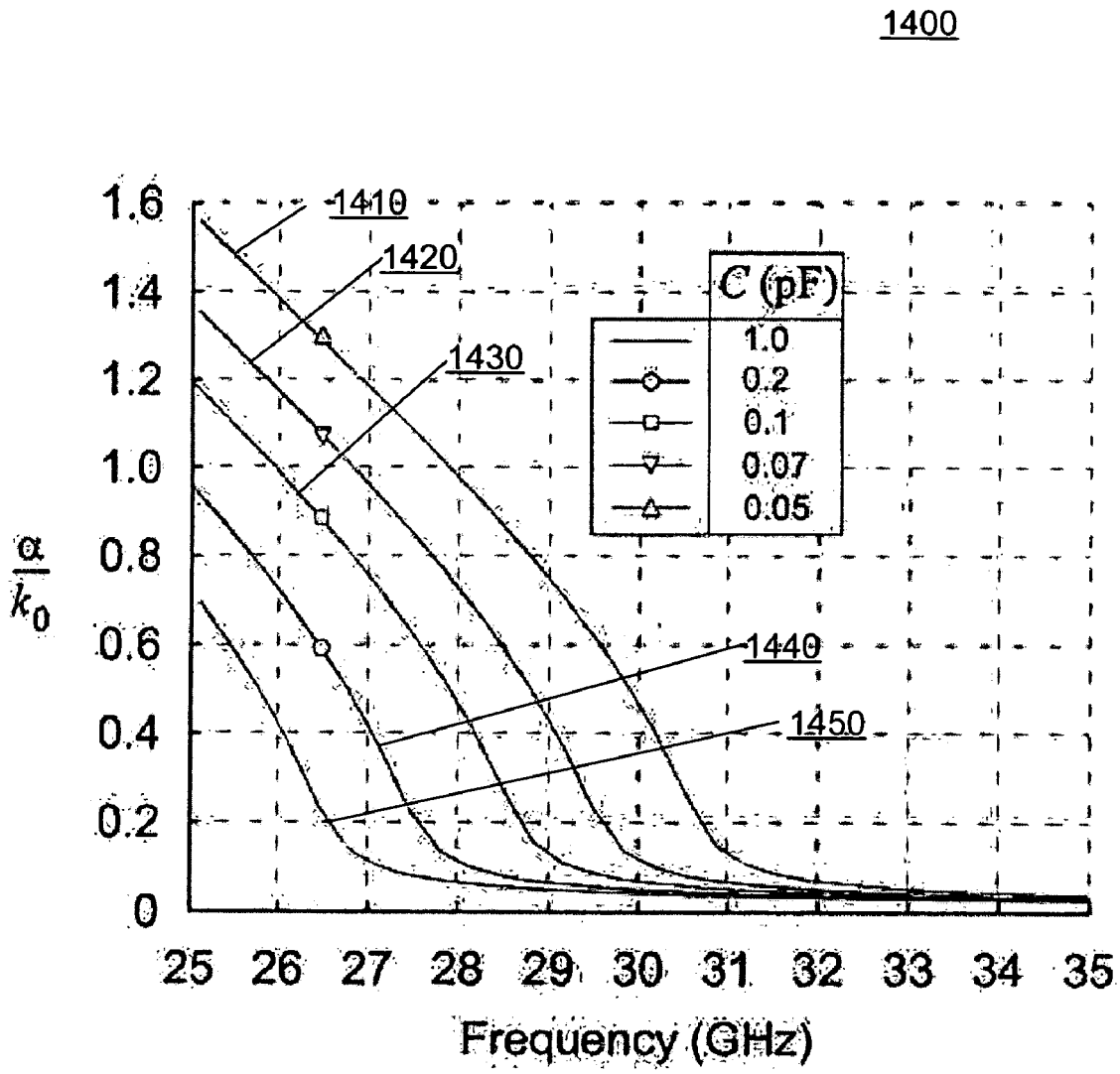
FIG. 14 is an illustration of a plot of the normalized leakage constant in a reactively loaded microstrip in accordance with one embodiment of the present invention.
Figure 15:
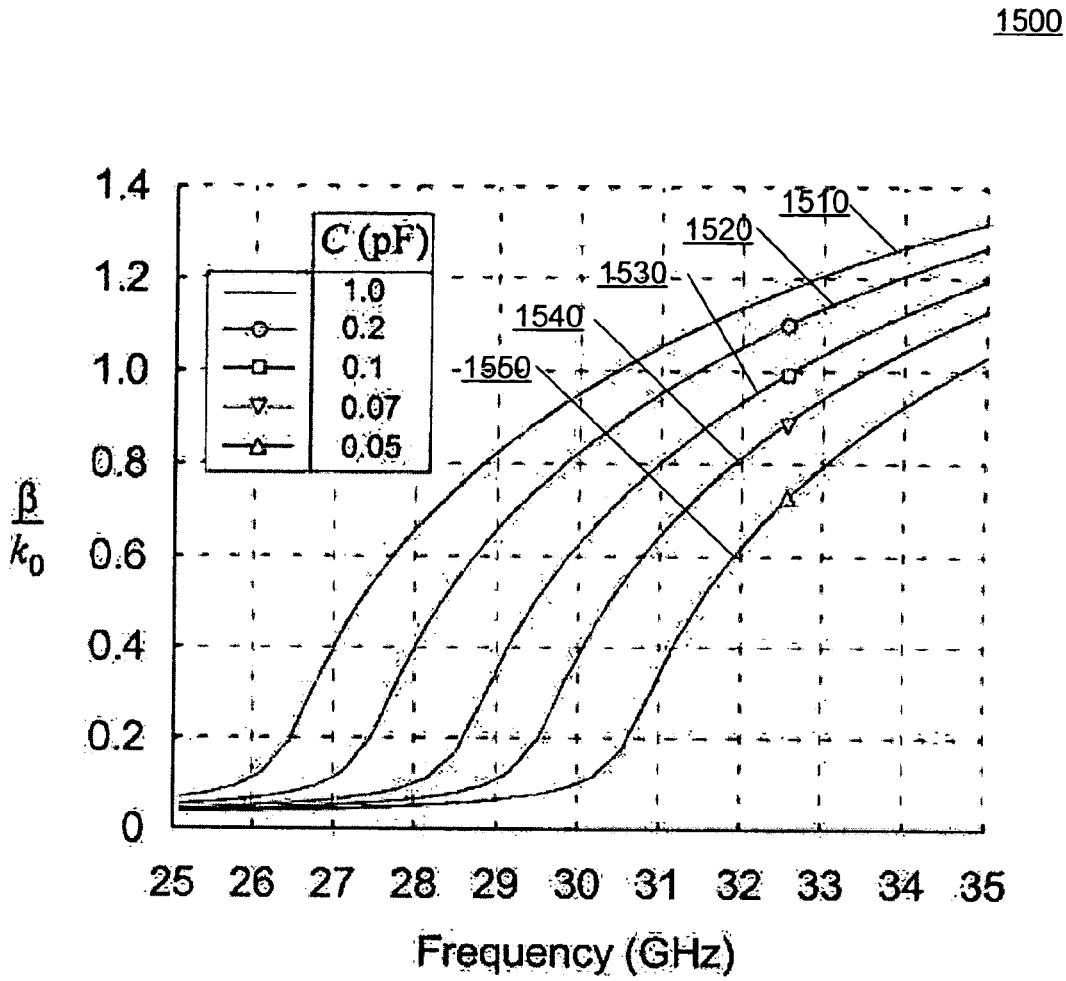
FIG. 15 is an illustration of a plot of the normalized phase constant in a reactively loaded microstrip in accordance with one embodiment of the present invention.

An analysis similar to that performed above may also be applied to a microstrip with a dielectric constant $\epsilon_r$=3.78, thickness h=0.127 mm, and strip width 2 d=2.67 mm. The results are shown in FIGS. 14, 15, and 16 for values of C ranging from 1.0 to 0.05 pF. In this illustrative case, a 64 degree main-beam scan range is achieved at a constant frequency f=30 GHz, and is accompanied by a shift of about 4 GHz in the cutoff frequency of the $EH_1$ mode.

The reactive loading implemented in the cells comprising the microstrip can take a variety of forms. In one embodiment, the reactive loading may include a ferroelectric film such as BST, as disclosed in "Superconductors spur application of ferroelectric films," O. Vendik, I. Mironenko, and L. Ter-Martirosyan, *Microwaves & RF*, vol. 33, no. 7, pp. 67–70, July 1994, and incorporated herein by reference. Alternatively, a periodic array of ferroelectric strips placed in shunt across the microstrip center gap can be used, and would result in antennas with a higher radiation efficiency. Another form of loading is a periodic array of varactors (Schottky or MEMS, as disclosed in "Distributed MEMS true-time delay phase shifters and wideband switches," N. S. Barker, and G. M. Rebeiz, *IEEE Transactions on Microwave Theory and Techniques*, vol. 46, no. 11, November 1998, and incorporated herein by reference) requiring a reverse-bias voltage range that is much smaller than that used in a microstrip implementation wherein elements are interconnected using varactor diodes, due to the shunt mounting of the varactors across the microstrip center gap. Other types of loading implementations using alternative varying reactive elements are considered within the scope of the present invention.

The phase velocity along a reactively loaded microstrip operating in its first higher-order mode may be varied continuously at constant frequency by varying its surface reactance. This effect can be used to achieve fixed-frequency continuous main-beam steering. It was also found that a change in the surface reactance is accompanied by a shift in the cutoff frequency of the first higher-order mode. This effect is similar to changing the width of the microstrip waveguide, and may be used in the design of antennas with a continuously adjustable operating frequency range. The reactively loaded microstrip may also be used as a variable-delay transmission line when operated below $f_{c1}$, the cutoff frequency of its first higher-order mode. On the other hand, when loaded periodically with reverse-biased Schottky varactors, and driven in large-signal mode at frequencies that are much smaller than $f_{c1}$ the structure may be used as a nonlinear transmission line for the generation of nonlinear waves such as electrical shock waves and solitons as disclosed in "Active and nonlinear wave propagation devices in ultra fast electronics and optoelectronics," M. J. W. Rodwell et al., *IEEE Proceedings*, vol. 82, no. 7, pp.1037–1058, July 1994, and herein incorporated by reference.

Other features, aspects and objects of the invention can be obtained from a review of the figures and the claims. It is to be understood that other embodiments of the invention can be developed and fall within the spirit and scope of the invention and claims.

The foregoing description of preferred embodiments of the present invention has been provided for the purposes of illustration and description. It is not intended to be exhaustive or to limit the invention to the precise forms disclosed. Obviously, many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

In the claims:

1. A fixed-frequency beam-steerable leaky-wave microstrip antenna comprising:

a grounded element;

a dielectric coupled to said grounded element; and conducting traces coupled to the dielectric, the conducing traces including:

a pair of non-radiating conductive elements; and a plurality of radiating strips, each of the radiating strips connected between the pair of non-radiating conductive elements, each of said plurality of radiating strips including a center-loaded varying reactance element.

2. The fixed frequency beam steerable leaky wave microstrip antenna of claim 1 wherein each of the varying reactance elements is a variable capacitor.

3. The fixed frequency beam steerable leaky wave microstrip antenna of claim 1 wherein each of the varying reactance elements is a varactor diode.

4. The fixed frequency beam steerable leaky wave microstrip antenna of claim 1 wherein the pair of non-radiating conductive elements includes:

a driving port having a first and second driving end, the first driving end configured to receive a first driving signal, the second driving end configured to receive a second driving signal, the first signal being 180 degrees-out-of-phase with the second driving signal;

a terminating port having a first terminating end and a second terminating end, the first terminating end connected to a first resistive load, the second terminating end connected to a second terminating load.

5. The fixed frequency beam steerable leaky wave microstrip antenna of claim 4 further comprising:

a biasing DC voltage source coupled between the first terminating end and the second terminating end.

6. The fixed frequency beam steerable leaky wave microstrip antenna of claim 1 wherein each of the radiating strips has the same width, length and inter-strip spacing.

7. A fixed frequency beam steerable leaky wave microstrip antenna, comprising:

a grounded element;

a dielectric coupled to said grounded element; and a pair of radiating strips coupled to said dielectric, the pair of radiating strips separated by a generally uniform gap and including:

variable reactance elements mounted in shunt across the gap, wherein the pair of radiating strips includes:

a driving port having a first and second driving end, the first driving end configured to receive a first driving signal, the second driving end configured to receive a second driving signal, the first signal being 180 degrees-out-of-phase with the second driving signal;

a terminating port having a first terminating end and a second terminating end, the first terminating end connected to a first resistive load, the second terminating end connected to a second terminating load.

8. A fixed-frequency beam-steerable leaky-wave microstrip antenna comprising:

a grounded element;

a dielectric coupled to said grounded element; and a pair of radiating strips coupled to said dielectric, the pair of radiating strips separated by a generally uniform gap and including:

variable reactance elements mounted in shunt across the gap, wherein the pair of radiating strips includes:

a driving port having a first and second driving end, the first driving end configured to receive a first driving signal, the second driving end configured to receive a second driving signal, the first signal being 180 degrees-out-of-phase with the second driving signal;

a terminating port having a first terminating end and a second terminating end, the first terminating end connected to a first resistive load, the second terminating end connected to a second terminating load; a biasing DC voltage source coupled between the first terminating end and the second terminating end.

9. A method for generating a fixed-frequency beam-steerable leaky wave from a leaky wave microstrip antenna, comprising:

providing conducting traces coupled to a dielectric, the dielectric coupled to a grounded element, the conducting traces including:

a pair of non-radiating conducting strips; and a plurality of radiating strips, the plurality of radiating strips coupled between the pair of non-radiating conducting strips, each of said plurality of radiating strips including:

a variable reactive-element having a reactance value;

driving the microstrip with a 180-degree hybrid fixed-frequency signal, the signal configured to excite the micro strip in a first higher order mode and configure the leaky wave antenna to transmit a beam-steerable leaky wave;

varying the variable reactive-element reactance value to provide continuous fixed frequency main beam steering.

10. The method of claim 9 wherein each of the variable reactive-elements is center loaded on each of the plurality of radiating strips.

11. The method of claim 9 wherein each of the variable reactance-elements is a varactor diode.

12. The method of claim 9 wherein each of the plurality of radiating strips is configured to have a substantially similar length, width and inter-strip spacing.

13. A method for generating a fixed-frequency beam-steerable leaky wave from a leaky-wave microstrip antenna, comprising:

providing conducting traces coupled to a dielectric, the dielectric coupled to a grounded element, the conducting traces including:

a pair of radiating strips, the pair of radiating strips separated by a generally uniform gap and including: variable reactance-elements having a reactance value and mounted in shunt across the gap;

driving the radiating strips with a 180-degree-hybrid fixed-frequency signal, the signal configured to excite the micro strip in a first higher order mode and configure the leaky wave antenna to transmit a beam steerable leaky wave;

varying the variable reactance-element reactance value to provide continuous fixed-frequency main-beam steering.

14. The method of claim 13 wherein each of the variable reactance-elements is a varactor diode.

* * * * *